US009573377B2

(12) United States Patent
Gengrinovich et al.

(10) Patent No.: US 9,573,377 B2
(45) Date of Patent: Feb. 21, 2017

(54) INK DELIVERY SYSTEM

(75) Inventors: Semion Gengrinovich, Ramat Gan (IL); Ran Vilk, Qiryat Ono (IL); Lev Superfin, Netanya (IL)

(73) Assignee: Hewlett-Packard Industrial Printing LTD., Netanya (IL)

( * ) Notice: Subject to any disclaimer, the term of this patent is extended or adjusted under 35 U.S.C. 154(b) by 0 days.

(21) Appl. No.: 13/548,502

(22) Filed: Jul. 13, 2012

(65) Prior Publication Data

US 2014/0015903 A1 Jan. 16, 2014

(51) Int. Cl.
*B41J 2/175* (2006.01)

(52) U.S. Cl.
CPC ..... *B41J 2/175* (2013.01)

(58) Field of Classification Search
CPC ..... B41J 2/175; B41J 2/17596
USPC ..... 347/7, 20, 23, 84, 85
See application file for complete search history.

(56) References Cited

U.S. PATENT DOCUMENTS

| | | | | |
|---|---|---|---|---|
| 4,329,696 | A * | 5/1982 | Denlinger et al. | 347/6 |
| 4,602,662 | A * | 7/1986 | Eremity et al. | 141/198 |
| 5,485,187 | A * | 1/1996 | Okamura | B41J 2/175 347/85 |
| 6,082,851 | A * | 7/2000 | Shihoh et al. | 347/85 |
| 6,188,417 | B1 * | 2/2001 | Keefe et al. | 347/86 |
| 6,302,516 | B1 * | 10/2001 | Brooks | B41J 2/175 347/35 |
| 6,540,340 | B2 | 4/2003 | Thorpe et al. | |
| 7,682,008 | B2 | 3/2010 | Platt et al. | |
| 7,806,520 | B2 * | 10/2010 | Watanabe | 347/85 |
| 7,901,063 | B2 | 3/2011 | Wouters et al. | |
| 8,070,248 | B2 * | 12/2011 | Ogama | 347/14 |
| 8,220,896 | B2 * | 7/2012 | Nystrom et al. | 347/19 |
| 2004/0174417 | A1 * | 9/2004 | Kobayashi et al. | 347/85 |
| 2011/0025768 | A1 | 2/2011 | Rosati et al. | |
| 2011/0074887 | A1 | 3/2011 | Manders et al. | |
| 2011/0279592 | A1 * | 11/2011 | Hibbard | B41J 2/175 347/86 |
| 2011/0316904 | A1 * | 12/2011 | Isozaki et al. | 347/6 |
| 2012/0026254 | A1 * | 2/2012 | Tamaki | 347/85 |
| 2012/0105520 | A1 * | 5/2012 | Shimoda et al. | 347/6 |

FOREIGN PATENT DOCUMENTS

| | | | | |
|---|---|---|---|---|
| WO | WO 02096654 | A1 * | 12/2002 | B41J 2/175 |

OTHER PUBLICATIONS

"Ink Supply Systems for Web Offset"; Online advertisement at: http://lincoln.rubi.co.kr/design/default/images/down/Ink %20Supply%20Systems%20for%20Web%20offset_2007.pdf; 2007.

* cited by examiner

*Primary Examiner* — Matthew Luu
*Assistant Examiner* — Patrick King
(74) *Attorney, Agent, or Firm* — HP Inc. Patent Department

(57) ABSTRACT

An apparatus includes a tank for holding a fluid for delivery to a printhead, the tank being open to the atmosphere. A manifold enables the fluid to flow from the tank to the printhead, a height of the manifold being lower than a level of the fluid in the tank when the fluid is flowing from the tank to the printhead. A siphon has a lower end of the siphon that is connectable to the manifold. An upper end of the siphon extends above the level of the fluid and is openable to the atmosphere. A height of a segment of the siphon between the upper end and the lower end is lower than the height of the manifold.

20 Claims, 4 Drawing Sheets

INK DELIVERY SYSTEM

BACKGROUND

In an inkjet printer, ink is ejected from a printhead so as to be deposited on a substrate. The ink is stored in a container and is conveyed to the printhead. The printhead is operated so as to eject a drop of ink when required.

An inkjet printer that is designed for commercial use or for large-scale printing may be expected to print on a large substrate, or on a large number of substrates, in a short amount of time. In able to achieve acceptably high throughput, the inkjet printer may be provided with a large number of printheads arranged in a printhead array. The printhead modules of the array may be operated concurrently. For example, the length of a printhead array may be on the order of meters, and may include tens or hundreds of printhead modules. The printer may be designed to produce a large printed product (e.g. 4 meters long and 1.8 meter wide) in a few (e.g. less than four) minutes.

Such printing capability requires supplying a large amount of ink to the printhead array. For example, ink may be provided in large (e.g. 5 liter) supply tanks. The ink is conveyed from the supply tanks to the printhead modules as needed.

DETAILED DESCRIPTION

Figure 1:
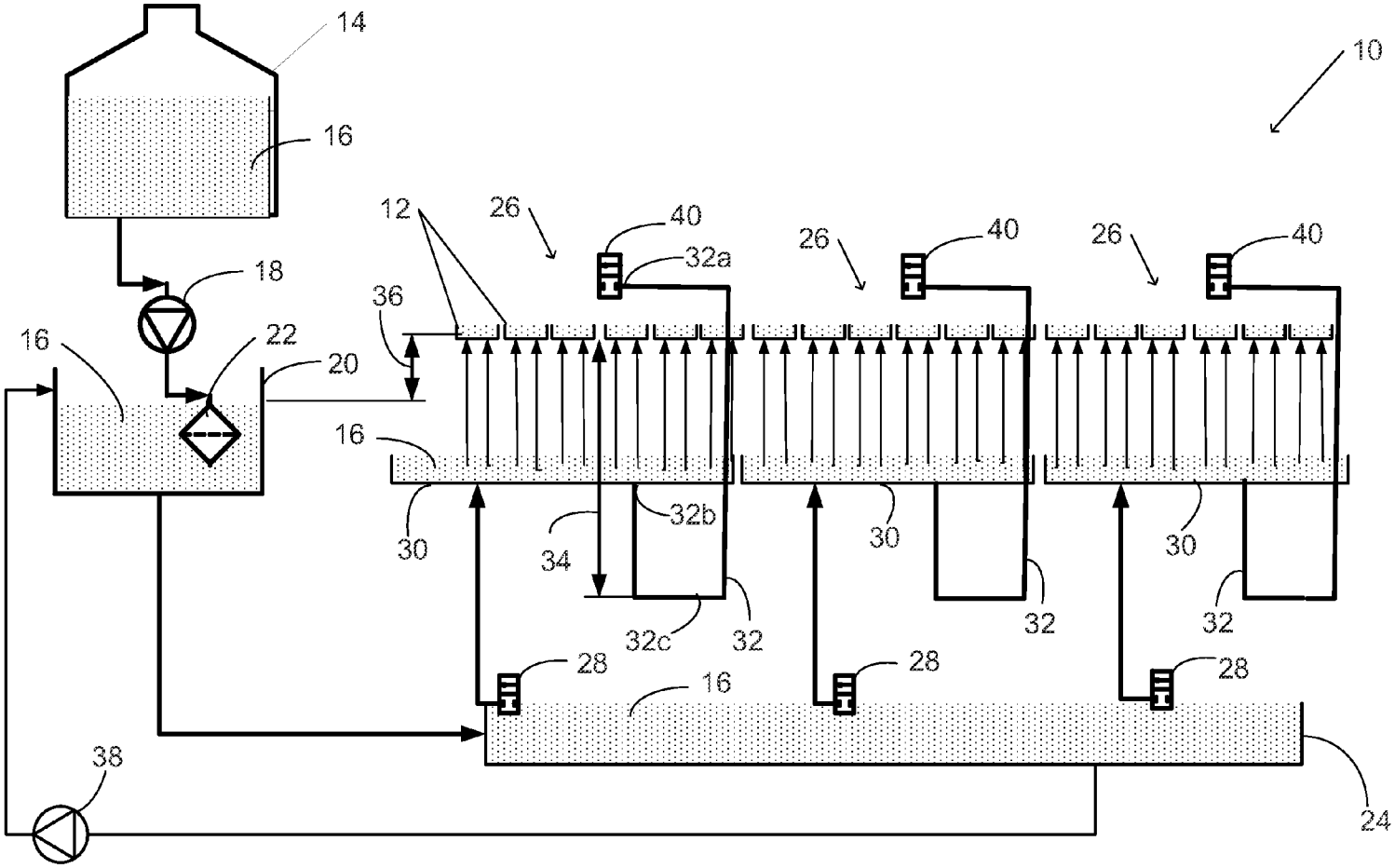
FIG. 1 is a schematic illustration of an example of a printer with an ink delivery system.

In accordance of an example of an ink delivery system, ink is supplied to a printhead of a printer. Ink, as used herein, should be understood as including any fluid (e.g. ink, paint, or cleaning fluid) that may be provided to a printhead of the printer. Ink is conveyed to an internal chamber or cavity of the printhead. The printhead may be operated to expel drops of the fluid through nozzles of the printhead. A mechanism of the printhead may be operated on demand to expel a drop of ink from the internal chamber or cavity through a nozzle that opens to the chamber or cavity. For example, the mechanism may be operated when the nozzle is opposite or in the vicinity of a point on the substrate where the ink is to be deposited.

For example, in a high-speed printer, the mechanism may be a piezoelectric mechanism having a rapid response time. Operation of the piezoelectric mechanism may create a sudden and instantaneous pressure wave in the ink that is inside the internal chamber or cavity of the printhead. The pressure wave may cause a drop of ink to separate from the remainder of the ink. The separated drop may be expelled through the nozzle.

The printheads of the printer are arranged in a printhead array. Ink may be supplied to the various printheads of the printhead array via a system of manifolds that channel ink from a common ink supply, such as a tank, to each of the printheads. Separate ink delivery systems, each including printhead arrays, manifolds, and ink supply tanks, may be provided for different types (e.g. colors) of ink that may be used. A printer system may include a plurality of ink delivery systems.

An ink delivery system includes a secondary or buffer tank for holding ink that is to be supplied to printheads of the printer. The secondary tank is open to the atmosphere, or may be opened to the atmosphere during printing. (A connection to the atmosphere may be closed with the ink delivery system is idle or otherwise not being operated to supply ink to a printhead. Closing the connection may prevent spillage, evaporation, or contamination of the ink.) A level of ink in the secondary tank is maintained at a height that is below the height of the printheads. As ink from the secondary tank is delivered to the printheads, ink in the secondary tank may be replenished or supplemented from a supply tank. Thus, a desired level of ink may be maintained in the secondary tank. A valve or pump may be operated to control flow of ink from the supply tank to the secondary tank. A filter may remove suspended impurities from ink that is supplied to the secondary tank.

By maintaining a level of ink in the secondary tank that is below the height of the printheads, pressure of the ink in the printheads may be reduced below that of the pressure of fluid in the secondary tank. Since the pressure of the ink in the secondary tank is in equilibrium with the atmosphere, pressure of the ink in the printheads may thus be maintained at a pressure that is below atmospheric pressure. This negative or back pressure may assist in preventing ink from leaking or flowing out of a nozzle of any of the printheads when the ink is not being intentionally expelled. Thus, the printhead may be controlled, e.g. via a controlled mechanism such as a piezoelectric mechanism, to expel ink only on demand. Depositing of expelled drops of ink on the substrate in the form of deposited drops may thus be controlled in order to obtain a desired image (e.g. without undesired inkblots).

The ink is delivered from the secondary tank to the printheads of the printhead array via a manifold. For example, ink may be conducted from the secondary tank to the manifold via a channel or conduit. The manifold is located at a height that is lower than the level of ink in the secondary tank. Thus, gravity may cause ink to flow from the secondary tank to the manifold via the channel, thus maintaining a quantity of ink in the manifold.

In accordance with examples of an ink delivery system as described herein, the manifold is connectable to the ambient atmosphere via a siphon. One end of the siphon, an upper end, is openable to the atmosphere. For example, the upper end may be opened to the atmosphere during printing. During printing, a valve at the upper end of the siphon may be opened, thus opening the upper end of the siphon to the atmosphere. The upper end that may be opened to the atmosphere is located at a height that is above the level of ink in the secondary tank. The other, lower end of the siphon is connectable to the manifold. For example, the lower end may be connected to or disconnected from the manifold via operation of a switching valve. A segment or section of the siphon between the upper end and the lower end passed at a height that is lower than the height of the manifold.

During printing, ink is drawn by the printheads from the manifold. When opened to the atmosphere and connected to the manifold, the siphon may fill with ink to a height level that is up to (e.g. no more than) the level of the ink in the secondary tank. When ink is initially drawn from the manifold to the printheads, ink may flow out of the siphon into the manifold. For example, as printing continues, quantities of ink in the manifold and in the siphon may reach equilibrium levels. Thus, the siphon may enable maintaining a sufficient quantity of ink within the manifold so as to enable uninterrupted high-speed printing.

A siphon in accordance with examples of an ink delivery system as described herein may assist in preventing interruption of delivery of ink to the printheads during high-speed printing. For example, some printers whose supply systems do not include a siphon as described herein may include a tube that extends upward from the manifold and which could be opened to the atmosphere during printing. At a sufficiently slow printing speed, the ink that would enter such a tube could be sufficient to enable continuous printing. However, if the printing speed were to be increased beyond some limit in a printer with such a tube, the ink in the manifold could be temporarily exhausted. Exhaustion of ink in the manifold could result in interruption of delivery of ink to the printheads. Thus, a mechanism for expelling a drop of ink from a printhead nozzle would not operate properly, such that drops of ink would not be deposited correctly on the substrate. Examples of an ink delivery system with a siphon as described herein may maintain a level of ink in the manifold that enables faster printing speeds than would be enabled in the absence of such a system. The level may be maintained without any modification of relative placement of other components of the ink delivery system, such as a height difference between a level of ink in the secondary tank and the printheads.

FIG. 1 is a schematic illustration of an example of a printer with an ink delivery system.

Ink delivery system 10 is configured to provide ink from a supply tank 14 to a plurality of printheads 12. Printheads 12 may be arranged in groups such as printhead clusters 26.

Supply tank 14 is configured to hold ink 16. Supply tank 14 may be removable or replaceable. For example, when supply tank 14 is empty, supply tank 14 may be replaced, or removed, refilled, and replaced. A structure for holding supply tank 14 may be configured to facilitate replacement.

Ink 16 from supply tank 14 may be pumped by ink pump 18 into secondary tank 20. Ink 16 that is added to secondary tank 20 may be filtered by ink filter 22. Ink filter 22 may remove any suspended particles (that could, e.g. interfere with operation of ink delivery system 10 or of printheads 12 were they not removed) from ink 16.

Secondary tank 20 serves as a buffer tank. Secondary tank 20 may be opened to the atmosphere, at least during printing by printheads 12. For example, a valve, port, or door of secondary tank 20 may be opened to the atmosphere. A level of ink 16 in secondary tank 20 is maintained at a height that is lower than that of printheads 12. The height difference between printheads 12, on the one hand, and a level of ink 16 in secondary tank 20, on the other hand, is represented by double-headed arrow 36 (henceforth, height difference 36). For example, in some examples of an ink delivery system 10, height difference 36 may represent a distance of about 25 to 30 millimeters. Height difference 36 may maintain a negative pressure (e.g. fluid pressure less than atmospheric pressure) of ink in printheads 12 during printing by printheads 12.

Ink 16 may flow from secondary tank 20 into ink channel 24. Ink channel 24 represents a common channel through which ink 16 may flow from secondary tank 20 to a plurality of manifolds 30. Ink channel 24 may be controllably connected to each manifold 30 via a valve 28. Opening a valve 28 enables ink 16 to flow from ink channel 24 into the corresponding manifold 30. Closing a valve 28 prevents ink 16 from flowing from ink channel 24 into the corresponding manifold 30.

Each manifold 30 is connected to a plurality of printheads 12 in a single printhead cluster 26. Thus, ink 16 may be provided from secondary tank 20 to each printhead 12 via ink channel 24 and the corresponding manifold 30. (Capillary forces within a connection between manifold 30 and printhead 12 may enable ink to rise to printhead 12 despite height difference 36.)

Pump 38 may operate to return ink from ink channel 24 to secondary tank 20. For example, pump 38 may operate during a purge cycle in which ink is run through printheads 12 and ink delivery system 10. A purge cycle may remove particulate matter or debris from components of ink delivery system 10 or from printheads 12. The ink that is returned to secondary tank 20 may be filtered by ink filter 22.

Each manifold 30 is provided with siphon 32. An upper end 32*a* of each siphon 32 may be opened to the atmosphere via siphon valve 40. For example, siphon valve 40 may be opened, thus opening siphon 32 to the ambient atmosphere. Siphon valve 40 may be opened when a printer system that operates a printhead 12 of the corresponding printhead cluster 26 is to print on a substrate (e.g. immediately prior to printing or concurrently with a printing operation). A lower end 32*b* of each siphon 32 is connected to, or is connectable to, a manifold 30. A segment 32*c* of siphon 32 between upper end 32*a* and lower end 32*b* extends below the connected manifold 30. A difference in height between segment 32*c* and a printhead 12 is indicated by double-headed arrow 34 (henceforth, height difference 34). For example, height difference 34 may represent a distance of about 125 to 150 millimeters.

When upper end 32*a* of siphon 32 is opened to the atmosphere (e.g. in the absence of other forces that may affect the level of ink in siphon 32, such as forces that result from expulsion of ink by a printhead 12), ink in siphon 32 may rise to a level approximately equal to a level of ink 16 in secondary tank 20. During printing by printheads 12, ink 16 may be withdrawn from manifold 30 to be expelled by printheads 32 of the corresponding printhead cluster 26. Withdrawal of ink 16 may result in flow of ink from siphon 32 into manifold 30. In this manner, a desired quantity of ink 16 may be maintained in manifold 30 during the printing operation. Siphon 32 may thus facilitate providing a continuous supply of ink to printheads 12 when printing.

Figure 2:
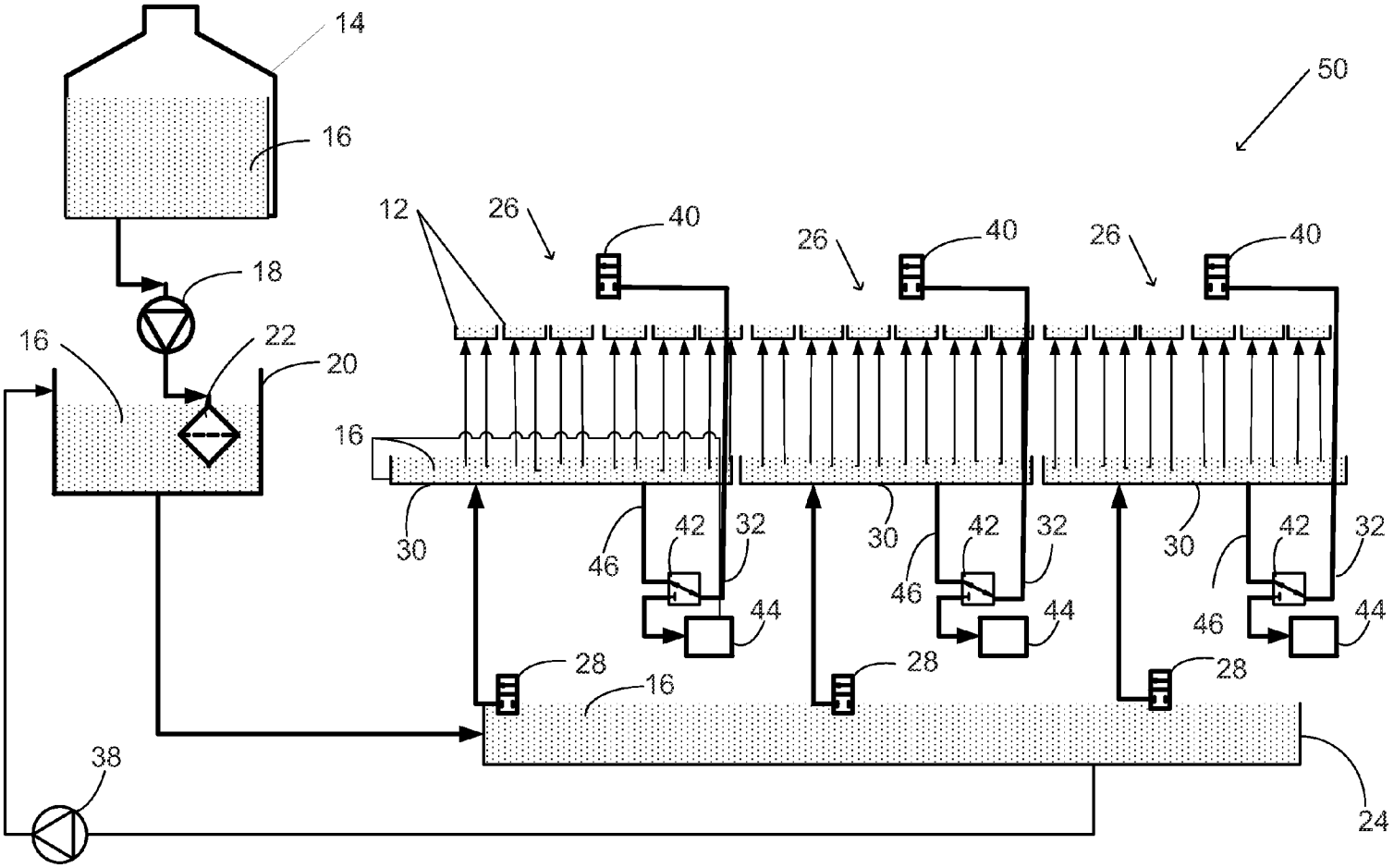
FIG. 2 is a schematic illustration of an example of a variant of an ink delivery system for a printer.

In other examples of an ink delivery system as described herein, additional structure or components may be included. FIG. 2 is a schematic illustration of an example of a variant of an ink delivery system for a printer.

Ink delivery system 50 is configured to facilitate switching between a printing mode and a purging mode. Switching valve 42 may be controlled to connect manifold connection 46 either to siphon 32 or to drain 44.

When printheads 12 are to print, switching valve 42 may be controlled to connect manifold connection 46 to siphon 32. In this configuration, siphon valve 40 may be opened such that siphon 32 is opened to the atmosphere and to manifold 30. In this manner, siphon 32 may function as described above (e.g. in connection with FIG. 1). Siphon 32 may thus facilitate providing a continuous supply of ink to printheads 12 when printing.

At other times, ink delivery system 50 may be purged. For example, ink may be pumped or otherwise caused to flow through components of ink delivery system 50, such as printheads 12. Such purging may maintain ink delivery system 50 in an operational condition. For example, purging may remove debris from components of ink delivery system 50. During purging, switching valve 42 may be controlled to connect manifold connection 46 to drain 44. Thus, during purging, ink, and any suspended debris, that is drained from components of ink delivery system 50 may be directed out of manifold 30 through drain 44. For example, drain 44 may connect to ink channel 24. Pump 38 may be operated to pump purged ink from ink channel 24 into secondary tank 20. The purged ink may be filtered by filter 22 so as to remove any suspended debris or other particulate matter from the returned ink.

Figure 3:
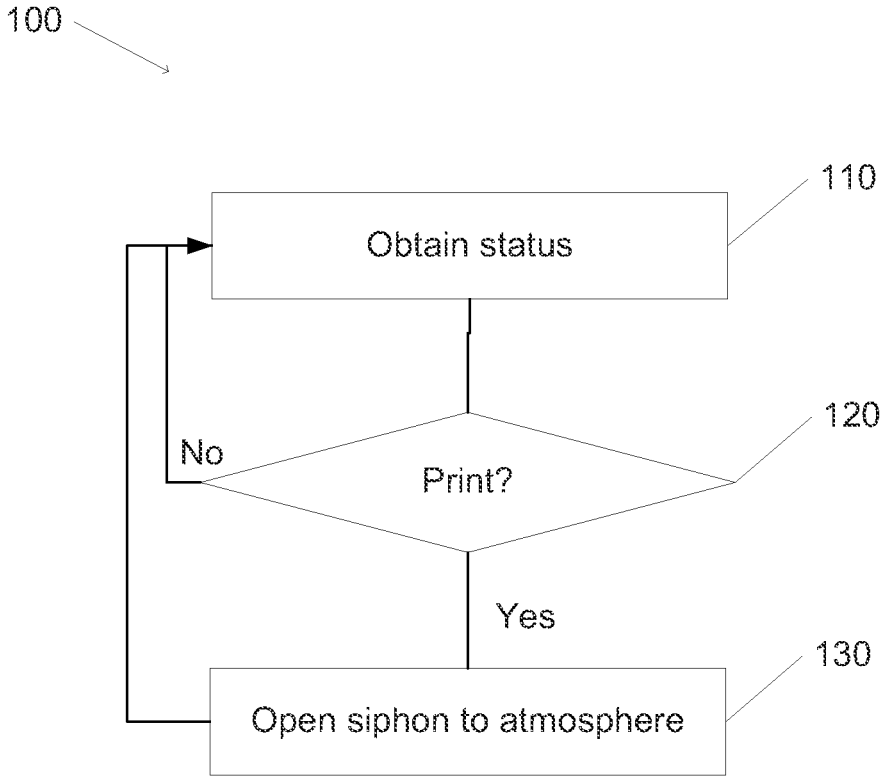
FIG. 3 is a flowchart depicting an example of a method for control of an ink delivery system.

Examples of an ink delivery system may be operated in accordance with a method. FIG. 3 is a flowchart depicting an example of a method for control of an ink delivery system.

It should be understood with respect to the flowchart that the division of the illustrated method into discrete operations represented by blocks of the flowchart has been selected for convenience and clarity only. Alternative division of the illustrated method into discrete operations is possible with equivalent results. Such alternative division of the illustrated method into discrete operations should be understood as representing other examples of the illustrated method.

Similarly, it should be understood that, unless indicated otherwise, the illustrated order of execution of the operations represented by blocks of the flowchart has been selected for convenience and clarity only. Operations of the illustrated method may be executed in an alternative order, or concurrently, with equivalent results. Such reordering of operations of the illustrated method should be understood as representing other examples of the illustrated method.

Ink delivery control method 100 may be executed by a controller or processor that is associated with an ink delivery system, such as ink delivery system 10 (FIG. 1) or ink delivery system 50 (FIG. 2), or with a printer system with which the ink delivery system is associated. Ink delivery control method 100 may be executed during operation of the ink delivery system or of the printer system. Ink delivery control method 100 may be executed at predetermined intervals, or in response to a predetermined event. A predetermined event may include, for example, beginning a printing operation on a printer system that includes or is associated with the ink delivery system. (A printing operation may be initiated, e.g., by a user-initiated command via an appropriate control or other input device, or may be initiated by an application that is running on a processor that is associated with the printer system.) An event may include any other sensed condition that is associated with a printer system or with an ink delivery system.

Execution of ink delivery control method 100 may include obtaining a status of the ink delivery system or of a printer system with which the ink delivery system is associated (block 110). For example, a change of status may be reported or transmitted by an appropriate component of the printer system or of the ink delivery system to a controller or processor that is executing ink delivery control method 100. As another example, a controller or processor that is executing ink delivery control method 100 may query components of the printer system when starting execution of ink delivery control method 100, or periodically during the course of execution.

An obtained status may include an operation (e.g. printing or purging) that is currently being performed by the printer system or by the ink delivery system. The status may include an operation that is to be performed by the printer system or by the ink delivery system. The status may include a current status of a valve (open or dosed), switching valve (switching position), or pump (operating or not) of the ink delivery system, or whether a printheads are being operated to expel ink. A status may include a sensed condition as sensed by one or more sensors (e.g. an ink level in a supply tank, secondary tank, ink channel, or manifold; a flow rate of ink in an ink channel or manifold; presence of a substrate on which ink is to be deposited; or any other condition that may be relevant to operation of an ink delivery system).

The obtained status may be analyzed to determine whether or not printing is indicated (block 120). The current status may be compared with a predetermined set of conditions. For example, the status may indicate that printing has commenced or that preparation for printing is taking place.

If printing is indicated, a siphon of the ink delivery system (e.g. siphon 32 in FIG. 1) may be opened, or may be verified to be opened, to the atmosphere (block 130). For example, a siphon valve 40 (FIG. 1) may be opened, or may be verified to be opened, such that an upper end of the siphon is open to the atmosphere. A lower end of the siphon may be opened to a manifold of the ink delivery system (e.g. as in ink delivery system 10 in FIG. 1). An ink delivery system may include a switching valve (e.g. ink delivery system 50 with switching valve 42 as shown in FIG. 2). In such an ink delivery system, the switching valve may be operated, or a status of the switching valve may be verified, so as to ensure that a lower end of the siphon is connected to the manifold.

Thus, when the upper end is opened to the atmosphere, ink from the manifold may enter the siphon to a height that is approximately equal to an equilibrium height (e.g. to a level of ink in a secondary tank that is opened to the atmosphere—the level of ink in the siphon may change, e.g. become lower, during high-speed printing). Thus, the siphon that is opened to the atmosphere may enable maintenance of a level (e.g. a minimum level) of ink in the manifold. Maintenance of a level of ink in the manifold may enable a continuous supply of ink to printheads that are connected to the manifold.

If the obtained status does not indicate printing, e.g. a printing operation has ended or another operation other than printing is being performed by the printer system or by the ink delivery system, the siphon need not be opened to the atmosphere. An updated status may be obtained or checked, and execution of ink delivery control method 100 may continue (returning to block 110).

An indicated status may indicate that the siphon be closed to the atmosphere. For example, a siphon valve may be closed such that the siphon is no longer connected to the atmosphere. Such closing may be indicated, e.g. when the printer system or the ink delivery system is idle, or during a purging operation. Closing the siphon to the atmosphere may prevent loss or contamination of ink.

During a purging operation, a switching valve (e.g. switching valve 42 of ink delivery system 50 in FIG. 2) may be operated so as to facilitate draining of purged ink. For example, a manifold of the ink delivery system may be connected to a drain. Connection to the drain may enable the purged ink with any suspended particles or debris to be drained out of the ink delivery system. A pump 38 (FIGS. 1 and 2) may be operated to return the drained ink to a secondary tank 20 (FIGS. 1 and 2).

Figure 4:
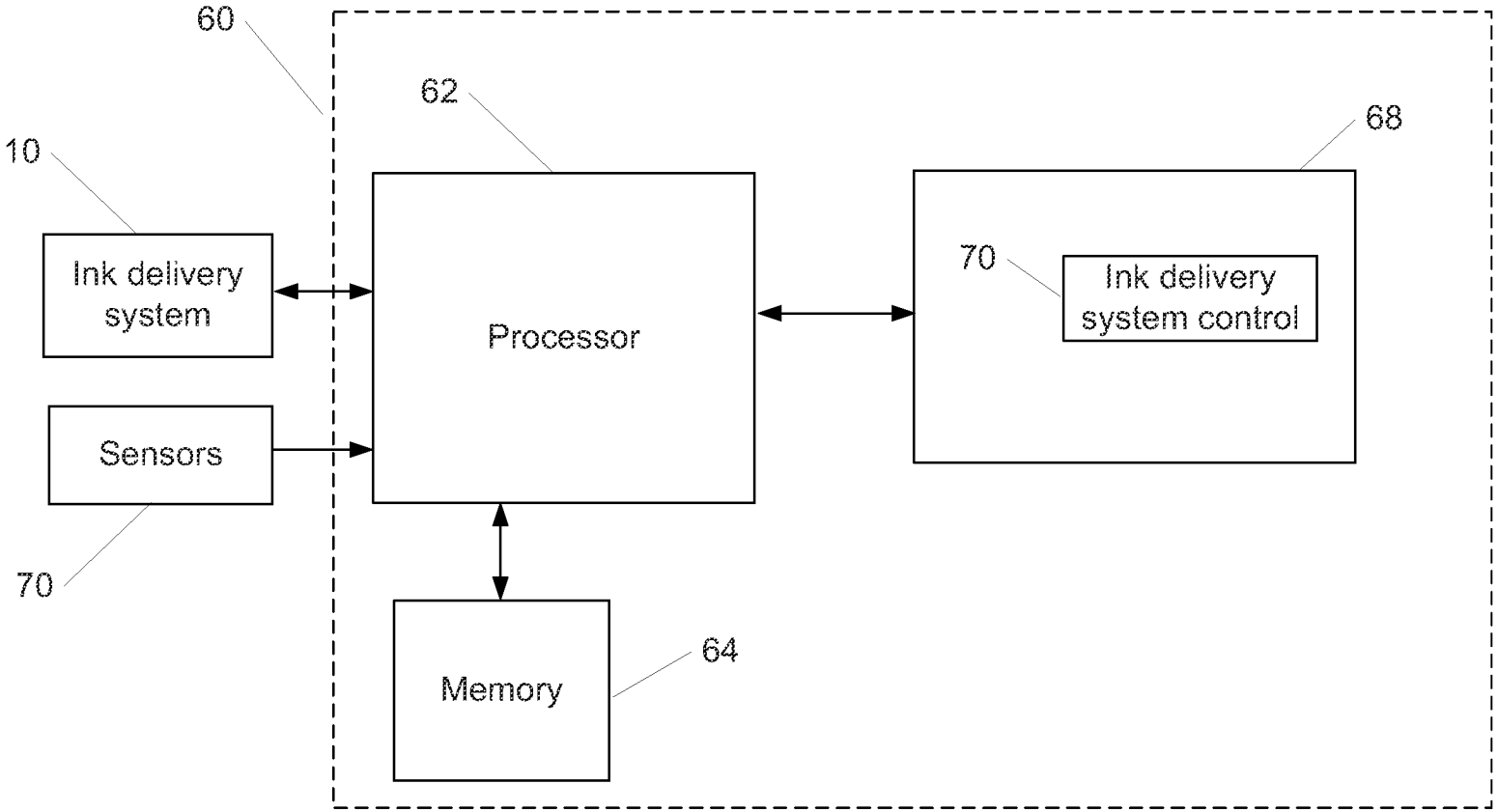
FIG. 4 is a schematic illustration of an example of a controller for ink delivery system.

A controller may be configured to execute ink delivery control method 100, or another ink delivery control method. FIG. 4 is a schematic illustration of an example of a controller for an ink delivery system.

Controller 60 may control operation of ink delivery system 10 (FIG. 1) or ink delivery system 50 (FIG. 2). Controller 60 may be incorporated into ink delivery system 10, or into a printer system with which ink delivery system 10 or ink delivery system 50 is associated (or into which it is incorporated). Controller 60 may include components that are external to ink delivery system 10. For example, components of controller 60 may be incorporated into a computer that communicates with ink delivery system 10, either through a direct (e.g. hardwired) connection, or via a wired or wireless network.

Controller 60 includes a processor 62. For example, processor 62 may include one or more processing units, e.g. of one or more computers. Processor 62 may be configured to operate in accordance with programmed instructions stored in memory 64. Processor 62 may be capable of executing an application for ink delivery system control.

Processor 62 may communicate with ink delivery system 10 or with ink delivery system 50. For example, communication with ink delivery system 10 or with ink delivery system 50 may include obtaining a current status of, or operating or changing a status of, a component of ink delivery system 10 or of ink delivery system 50, or of a printer system. Such a component may include a siphon valve or other valve, a switching valve, an ink pump or other pump, or a printhead.

Processor 62 may communicate with one or more sensors 70. For example, sensors 70 may include a sensor for detecting a level of ink in a component of ink delivery system 10 or of ink delivery system 50, a rate of flow of ink through a component of ink delivery system 10 or ink delivery system 50, a pressure in a component of ink delivery system 10 or of ink delivery system 50, or another condition.

Processor 62 may communicate with memory 64. Memory 64 may include one or more volatile or nonvolatile memory devices. Memory 64 may be utilized to store, for example, programmed instructions for operation of processor 62, data or parameters for use by processor 62 during operation, or results of operation of processor 62

Processor 62 may communicate with data storage device 68. Data storage device 68 may include one or more fixed or removable nonvolatile data storage devices. For example, data storage device 68 may include a computer readable medium for storing program instructions for operation of processor 62. In this example, the programmed instructions may take the form of ink delivery system control module 70 for controlling operation of ink delivery system 10 or of ink delivery system 50. It is noted that data storage device 68 may be remote from processor 62. In such cases data storage device 68 may be a storage device of a remote server storing ink delivery system control module 70 in the form of an installation package or packages that can be downloaded and installed for execution by processor 62. Data storage device 68 may be utilized to store data or parameters for use by processor 62 during operation, or results of operation of processor 62.

In accordance with an example of ink delivery system control, a computer program application stored in a computer-readable medium (e.g., register memory, processor cache, RAM, ROM, hard drive, flash memory, CD ROM, magnetic media, etc.) may include code or executable instructions that when executed may instruct or cause a controller or processor to perform methods discussed herein, such as an example of a method for ink delivery system control. The computer-readable medium may be a non-transitory computer-readable media including all forms and types of computer-readable media except for a transitory, propagating signal.

We claim:

1. An apparatus comprising:

a tank to hold a fluid for delivery to a printhead positioned higher than the tank, the tank being open to the atmosphere;

a manifold to enable the fluid to flow from the tank to the printhead, the entire manifold being lower than a level of the fluid in the tank; and a siphon, a lower end of the siphon being connectable to the manifold, an upper end of the siphon extending above the level of the fluid and being openable to the atmosphere, a height of a segment of the siphon between the upper end and the lower end being lower than the height of the manifold.

2. The apparatus of claim 1, wherein the upper end includes a valve that is operable to open or close the upper end to the atmosphere.

3. The apparatus of claim 1, comprising a switching valve that is operable to connect the siphon to the manifold, or to disconnect the siphon from the manifold.

4. The apparatus of claim 3, wherein the switching valve is further configured to connect the manifold to a drain, or to disconnect the manifold from the drain.

5. The apparatus of claim 1, wherein the level of the fluid is lower than a height of the printhead when the ink is flowing to the printhead.

6. The apparatus of claim 5, wherein a difference between the height of the printhead and the level of the fluid is in a range of 25 millimeters to 30 millimeters.

7. The apparatus of claim 5, wherein a difference between the height of the printhead and the height of the segment is in range of 125 millimeters to 150 millimeters.

8. The apparatus of claim 1, wherein the printhead comprises a printhead of a cluster of printheads that are connected to the manifold.

9. The apparatus of claim 8, wherein the cluster comprises a cluster of a plurality of clusters and the manifold comprises a manifold of a corresponding plurality of manifolds, such that the printheads in each of the clusters are connected to a common manifold of said plurality of manifolds, and the printheads of different clusters are collected to different manifolds.

10. The apparatus of claim 9, wherein the manifolds are each connectable to the tank via a common channel.

11. The apparatus of claim 10, wherein a manifold of said plurality of manifolds is provided with a valve that is operable to enable the fluid to flow from the common channel to that manifold.

12. The apparatus of claim 1, comprising a supply tank from which the fluid may be supplied to the tank.

13. A method comprising:

providing a system that includes:

a tank to hold a fluid for delivery to a printhead positioned higher than the tank, the tank being open to the atmosphere;

a manifold to enable ink to flow from the tank to a printhead, the manifold being configured such that the entire manifold is lower than a level of the ink in the tank; and a siphon, a lower end of the siphon being connectable to the manifold, an upper end of the siphon extending to a height that is higher than the level of the ink and being provided with a valve that is operable to open or close the upper end to the atmosphere, a segment of the siphon between the upper end and the lower end extending below the manifold; and operating the valve to open or close the upper end to the atmosphere.

14. The method of claim 13, wherein operating the valve comprises opening the valve when the system is to print.

15. The method of claim 13, further comprising operating a switching valve to connect the siphon to the manifold or to disconnect the siphon from the manifold.

16. The method of claim 15, wherein operating the switching valve comprises connecting the siphon to the manifold when the system is to print.

17. The method of claim 13, further comprising operating a switching valve to connect the manifold to a drain when the system is to be purged.

18. The method of claim 13, further comprising operating a pump.

19. A non-transitory computer readable storage medium having stored thereon instructions that when executed by a processor will cause the processor to operate a valve at an upper end of a siphon such that opening the valve opens the upper end to the atmosphere, a lower end of the siphon being connectable to a manifold, the siphon including a segment whose height is below a height of the manifold, the manifold being configured to enable ink to flow from a tank that is open to the atmosphere to a printhead positioned higher than the tank, the entire manifold being lower than a level of the ink in the tank.

20. The non-transitory computer readable storage medium of claim 19, wherein the instructions further include instructions to operate a switching valve.

* * * * *